US011316310B2

(12) United States Patent
Wu et al.

(10) Patent No.: US 11,316,310 B2
(45) Date of Patent: Apr. 26, 2022

(54) ELECTRICAL CONNECTOR

(71) Applicant: Cheng Uei Precision Industry Co., LTD., New Taipei (TW)

(72) Inventors: Yun Wu, Dong-Guan (CN); Hsin-Min Chao, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 16/987,347

(22) Filed: Aug. 6, 2020

(65) Prior Publication Data

US 2021/0399507 A1 Dec. 23, 2021

(30) Foreign Application Priority Data

Jun. 19, 2020 (CN) ..... 202021162959.2

(51) Int. Cl.

| | |
|---|---|
| ***H01R 24/64*** | (2011.01) |
| ***H01R 13/502*** | (2006.01) |
| ***H01R 24/40*** | (2011.01) |
| ***H01R 13/516*** | (2006.01) |
| *H01R 107/00* | (2006.01) |

(52) U.S. Cl.

CPC ..... *H01R 24/64* (2013.01); *H01R 13/502* (2013.01); *H01R 13/516* (2013.01); *H01R 24/40* (2013.01); *H01R 2107/00* (2013.01)

(58) Field of Classification Search

CPC .... H01R 24/54; H01R 13/502; H01R 13/516; H01R 24/40

USPC ..... 439/660

See application file for complete search history.

(56) References Cited

U.S. PATENT DOCUMENTS

| | | | | |
|---|---|---|---|---|
| 9,525,244 | B1 * | 12/2016 | Hsu | H01R 13/6594 |
| 9,923,286 | B2 * | 3/2018 | Cheng | H01R 13/65912 |
| 10,439,308 | B2 * | 10/2019 | Ju | H01R 13/6585 |
| 10,490,947 | B2 * | 11/2019 | Huang | H01R 13/5025 |
| 10,498,089 | B2 * | 12/2019 | Li | H01R 12/707 |
| 10,574,003 | B2 * | 2/2020 | Cheng | H01R 13/6597 |
| 2015/0072557 | A1 * | 3/2015 | Kamei | H01R 43/00 439/607.02 |
| 2015/0131245 | A1 * | 5/2015 | Amini | B23C 5/12 361/760 |
| 2017/0077651 | A1 * | 3/2017 | Chang | H01R 13/6581 |
| 2018/0366884 | A1 * | 12/2018 | Tseng | H01R 13/6585 |
| 2021/0249806 | A1 * | 8/2021 | Amini | H01R 12/592 |

* cited by examiner

*Primary Examiner* — Alexander Gilman
(74) *Attorney, Agent, or Firm* — Cheng-Ju Chiang

(57) ABSTRACT

An electrical connector includes an insulating housing, a center ground plate fastened in the insulating housing, a strengthening ground strap, and a terminal assembly fastened in the insulating housing. The strengthening ground strap is fastened to the insulating housing. The strengthening ground strap has a front slice and two lateral slices. The front slice is fastened to a front surface of the center ground plate. The top edge of the front slice is higher than a top surface of the center ground plate. A bottom edge of the front slice projects beyond a bottom surface of the center ground plate. The two lateral slices are disposed to two opposite sides of the center ground plate. The terminal assembly includes a plurality of high speed terminals disposed among the front slice and the two lateral slices.

18 Claims, 8 Drawing Sheets

ELECTRICAL CONNECTOR

CROSS-REFERENCE TO RELATED APPLICATION

The present application is based on, and claims priority from, China Patent Application No. 202021162959.2, filed Jun. 19, 2020, the disclosure of which is hereby incorporated by reference herein in its entirety.

BACKGROUND OF THE INVENTION

1. Field of the Invention

The present invention generally relates to a connector, and more particularly to an electrical connector having a better transmission stability.

2. The Related Art

In various connector types used by various electronic products frequently, universal serial bus (USB) connectors are the most widely applied connectors. With the improvement of science and technology, kinds of the universal serial bus connectors are more and more, such as USB 2.0, USB 3.0, Micro USB, Mini USB or USB TYPE-C. The USB TYPE-C connectors have been widely applied in the various electronic products.

However, a center plate of a current USB TYPE-C connector adopts a full plane design, a front end of a terminal of the current USB TYPE-C connector is unobstructed, when a high-frequency signal terminal of the current USB TYPE-C connector is under a high-speed data transmission operation, the high-frequency signal terminal will radiate electromagnetic waves with certain frequencies to disturb other wired devices or wireless devices, the high-frequency signal terminal is also easily affected by electromagnetic waves radiated from other wired devices or the wireless devices, so a transmission stability of the current USB TYPE-C connector is affected.

Thus, it is essential to provide an innovative electrical connector having a better transmission stability.

SUMMARY OF THE INVENTION

An object of the present invention is to provide an electrical connector. The electrical connector includes an insulating housing, a center ground plate fastened in the insulating housing, a strengthening ground strap, and a terminal assembly fastened in the insulating housing. The strengthening ground strap is fastened to a front surface and fronts of two opposite sides of the insulating housing. The strengthening ground strap has a front slice and two lateral slices. The front slice is fastened to and connected with a front surface of the center ground plate. The top edge of the front slice is higher than a top surface of the center ground plate, so an altitude difference is formed between the top edge of the front slice and the top surface of the center ground plate. A bottom edge of the front slice projects beyond a bottom surface of the center ground plate, so an altitude difference is formed between the bottom edge of the front slice and the bottom surface of the center ground plate. Two opposite sides of the front slice extend rearward and towards the center ground plate to form the two lateral slices. The two lateral slices are disposed to two opposite sides of the center ground plate. The terminal assembly includes a plurality of high speed terminals. The plurality of the high speed terminals are disposed among the front slice and the two lateral slices.

Another object of the present invention is to provide an electrical connector. The electrical connector includes an insulating housing, a center ground plate fastened in the insulating housing, a strengthening ground strap, and a terminal assembly fastened in the insulating housing. The insulating housing has a base body, and a tongue portion extended frontward from a middle of a front surface of the base body. The tongue portion has two opposite connecting surfaces, two opposite side surfaces, and a front surface connected with fronts of the two opposite side surfaces. The two opposite side surfaces and the front surface of the tongue portion surround the two opposite connecting surfaces of the tongue portion. The center ground plate has a main portion fastened in the tongue portion. The main portion has two opposite attaching surfaces, two opposite side edges and a front edge. The two opposite attaching surfaces of the main portion are surrounded by the two opposite side edges and the front edge of the main portion. The two opposite attaching surfaces of the main portion are corresponding to and located between the two opposite connecting surfaces of the tongue portion, the two opposite side edges of the main portion are corresponding to the two opposite side surfaces of the tongue portion, the front edge of the main portion is corresponding to the front surface of the tongue portion. The strengthening ground strap is fastened to the front surface and the two opposite side surfaces of the tongue portion of the insulating housing. The strengthening ground strap has a front slice and two lateral slices. Two opposite sides of the front slice extend rearward and towards the center ground plate to form the two lateral slices. The front slice is disposed to the front edge of the main portion. The two lateral slices are disposed outside the two opposite side edges of the main portion. An inner surface of the front slice is corresponding to the front edge of the main portion. A top edge and a bottom edge of the front slice are opposite to each other and exposed to fronts of the two opposite connecting surfaces of the tongue portion. Two inner surfaces of the two lateral slices are corresponding to the two opposite side edges of the main portion. Middles of top surfaces and bottom surfaces of the two lateral slices are exposed to two opposite sides of the tongue portion. The terminal assembly includes a plurality of high speed terminals. The plurality of the high speed terminals are disposed among the front slice and the two lateral slices.

Another object of the present invention is to provide an electrical connector. The electrical connector includes an insulating housing, a center ground plate fastened in the insulating housing, a strengthening ground strap, a terminal assembly fastened in the insulating housing, an upper ground plate disposed to a top surface of the insulating housing, and a lower ground plate disposed to a bottom surface of the insulating housing. The insulating housing has a base body, and a tongue portion extended frontward from a middle of a front surface of the base body. The tongue portion has two opposite connecting surfaces, two opposite side surfaces, and a front surface connected with the two opposite side surfaces. The two opposite connecting surfaces of the tongue portion are connected with tops and bottoms of the two opposite side surfaces and the front surface of the tongue portion. The center ground plate has a main portion fastened in the tongue portion. The main portion has two opposite attaching surfaces, two opposite side edges, and a front edge connected with fronts of the two opposite side edges. The two opposite attaching surfaces are connected with tops and bottoms of the two opposite side edges and the front edge of the main portion. The two opposite attaching surfaces of the main portion are corresponding to and located between the two opposite connecting surfaces of the tongue portion. The two opposite side edges of the main portion are corresponding to the two opposite side surfaces of the tongue portion. The front edge of the main portion is corresponding to the front surface of the tongue portion. The strengthening ground strap is fastened to a front surface and fronts of two opposite sides of the insulating housing. The strengthening ground strap has a front slice and two opposite lateral slices. Two opposite sides of the front slice extend rearward and towards the center ground plate to form the two lateral slices. The front slice is disposed to the front edge of the main portion. The two lateral slices are disposed outside the two opposite side edges of the main portion. An inner surface of the front slice is corresponding to the front edge of the main portion. A top edge and a bottom edge of the front slice are opposite to each other and exposed to fronts of the two opposite connecting surfaces of the tongue portion. Two inner surfaces of the two lateral slices are corresponding to the two opposite side edges of the main portion. Middles of top surfaces and bottom surfaces of the two lateral slices are exposed to two opposite sides of the tongue portion. The terminal assembly includes a plurality of high speed terminals. The plurality of the high speed terminals are disposed among the front slice and the two lateral slices. The upper ground plate is symmetrical to the lower ground plate with respect to the center ground plate.

As described above, the strengthening ground strap of the electrical connector is spot soldered to a front of an outer periphery of the main portion of the center ground plate, the front slice is fastened to and connected with the front edge of the main portion, the top edge of the front slice is higher than the top surface of the center ground plate, so the altitude difference is formed between the top edge of the front slice and the top surface of the center ground plate, the bottom edge of the front slice projects beyond the bottom surface of the center ground plate, so the altitude difference is formed between the bottom edge of the front slice and the bottom surface of the center ground plate, because the strengthening ground strap is disposed to fronts of outsides of an upper terminal assembly and a lower terminal assembly of the terminal assembly, electromagnetic interferences of a plurality of upper high speed terminals and a plurality of lower high speed terminals of the terminal assembly are reduced to improve a stability of high speed transmission of the electrical connector. As a result, the electrical connector has a better anti-electromagnetic interference capability and a better speed transmission stability.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
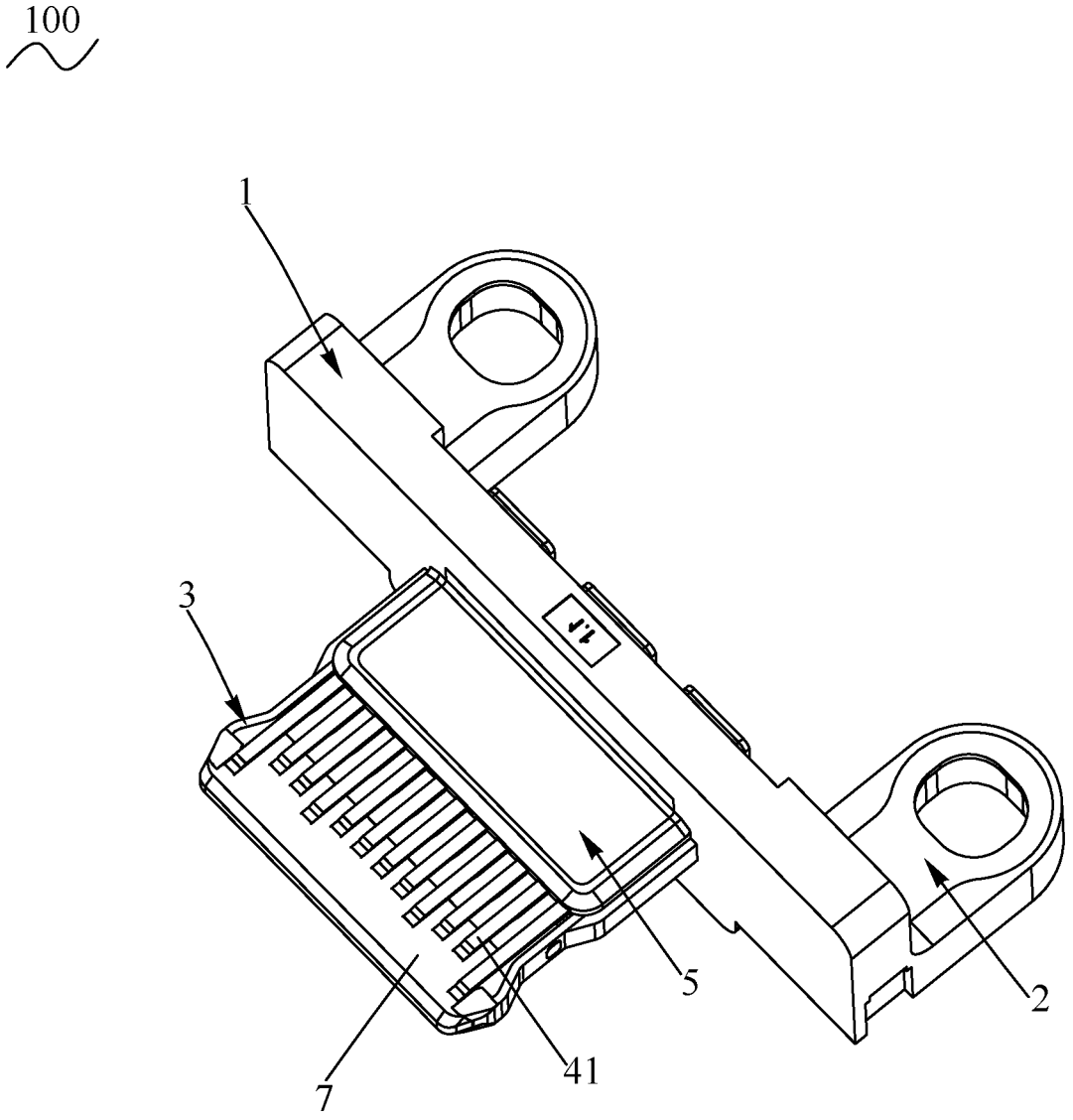
FIG. 1 is a perspective view of an electrical connector in accordance with a preferred embodiment of the present invention.
Figure 2:
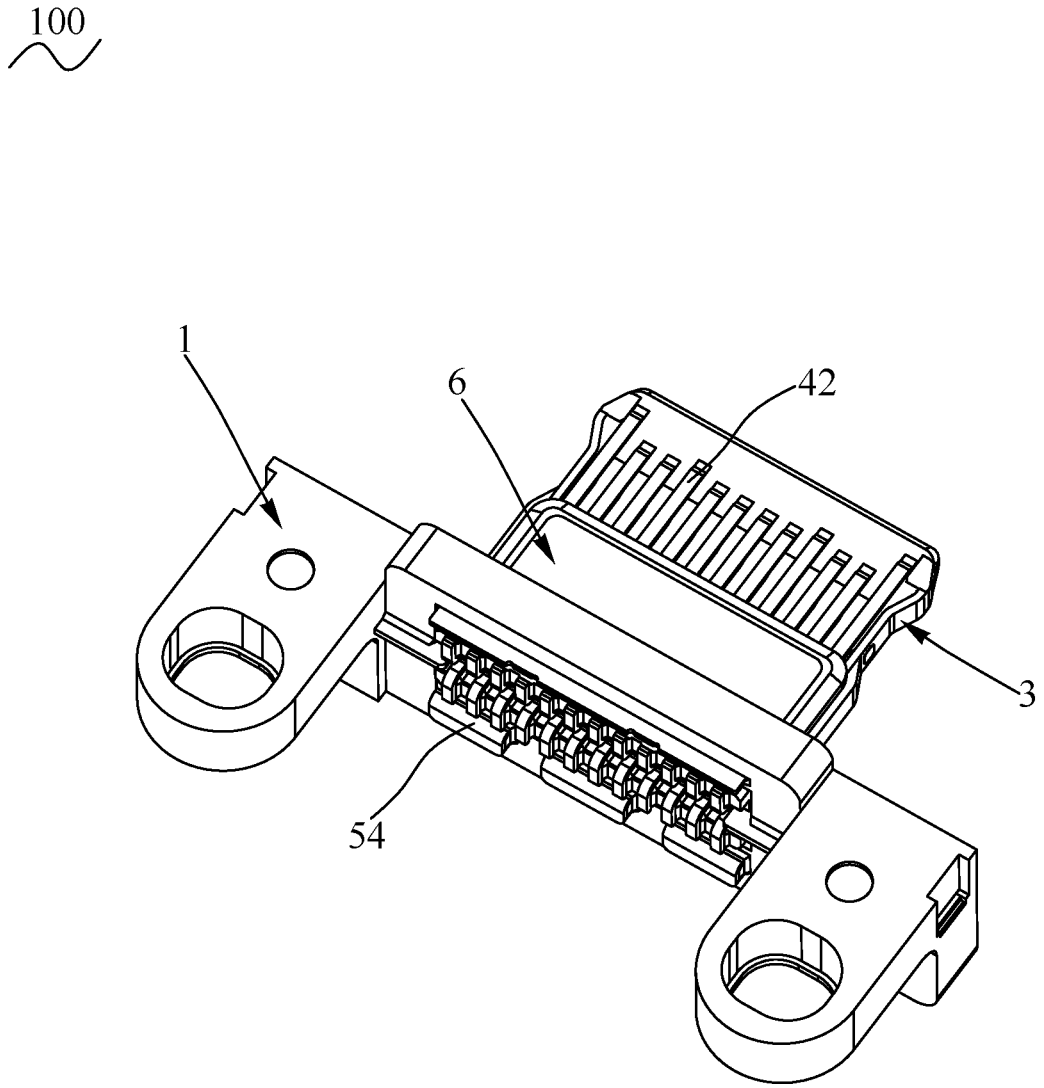
FIG. 2 is another perspective view of the electrical connector of FIG. 1.

With reference to FIG. 1 to FIG. 5, an electrical connector 100 in accordance with a preferred embodiment of the present invention is shown. The electrical connector 100 includes an insulating housing 1, a center ground plate 2, a strengthening ground strap 3, a terminal assembly 4, an upper ground plate 5 and a lower ground plate 6. In the preferred embodiment, the electrical connector 100 is a TYPE-C connector. In another specific embodiment of the present invention, the electrical connector 100 is another type connector which is different from the TYPE-C connector.

The center ground plate 2 is mounted in a middle of the terminal assembly 4, and the terminal assembly 4 and the center ground plate 2 are fastened in the insulating housing 1. The strengthening ground strap 3 is fastened to a front surface and fronts of two opposite sides of the insulating housing 1. The strengthening ground strap 3 is disposed to a front surface and two opposite sides of the center ground plate 2. The upper ground plate 5 is disposed to a top surface of the insulating housing 1. The lower ground plate 6 is disposed to a bottom surface of the insulating housing 1. The lower ground plate 6 and the upper ground plate 5 are disposed opposite to each other. The upper ground plate 5 is symmetrical to the lower ground plate 6 with respect to the center ground plate 2. In the preferred embodiment, the strengthening ground strap 3 is soldered to the center ground plate 2 to fasten the strengthening ground strap 3 to the front surface and the two opposite sides of the center ground plate 2, in addition, an overall structural strength is reinforced and an anti-electromagnetic interference capability of the electrical connector 100 is improved.

Referring to FIG. 1 to FIG. 4, the insulating housing 1 has a base body 10, a tongue portion 11, two stepping portions 12, two flanks 13 and two location perforations 14. The tongue portion 11 is extended frontward from a middle of a front surface of the base body 10. The tongue portion 11 has two opposite connecting surfaces 101, two opposite side surfaces 102, and a front surface 103 connected with fronts of the two opposite side surfaces 102. The two opposite side surfaces 102 and the front surface 103 of the tongue portion 11 surround the two opposite connecting surfaces 101 of the tongue portion 11. The two opposite connecting surfaces 101 of the tongue portion 11 are defined as a top surface and a bottom surface of the tongue portion 11. The two opposite connecting surfaces 101 of the tongue portion 11 are connected with tops and bottoms of the two opposite side surfaces 102 and the front surface 103 of the tongue portion 11. Rears of the top surface and the bottom surface of the tongue portion 11 are connected with the front surface of the base body 10. The rears of the top surface and the bottom surface of the tongue portion 11 have the two stepping portions 12 connected with the front surface of the base body 10. Lower portions of two opposite sides of a rear surface of the base body 10 extend rearward to form the two flanks 13. Rear ends of the two flanks 13 have the two location perforations 14 penetrating through a top surface and a bottom surface of the two flanks 13. A front end of the insulating housing 1 is surrounded by a docking portion 7.

Figure 3:
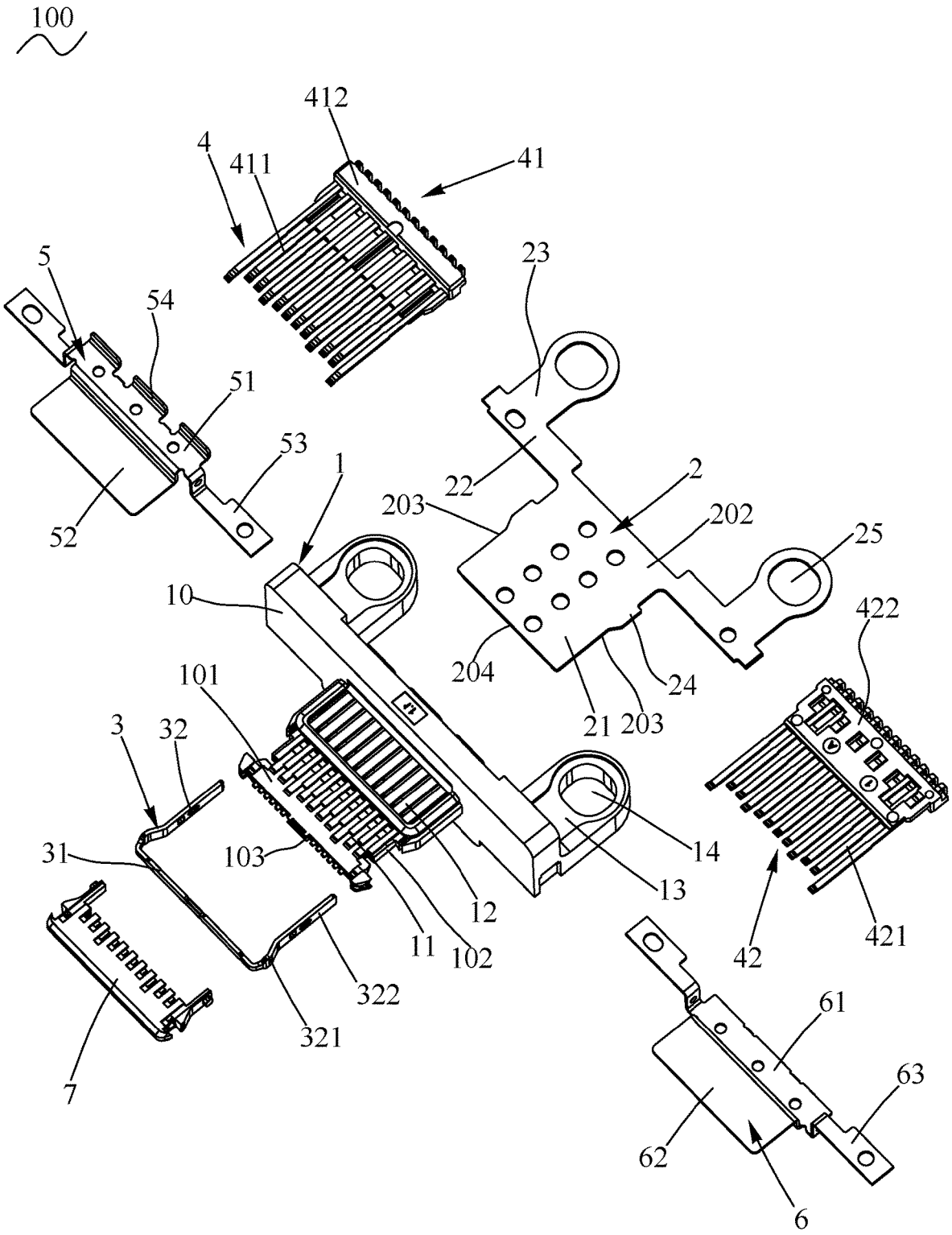
FIG. 3 is an exploded view of the electrical connector of FIG. 1.
Figure 4:
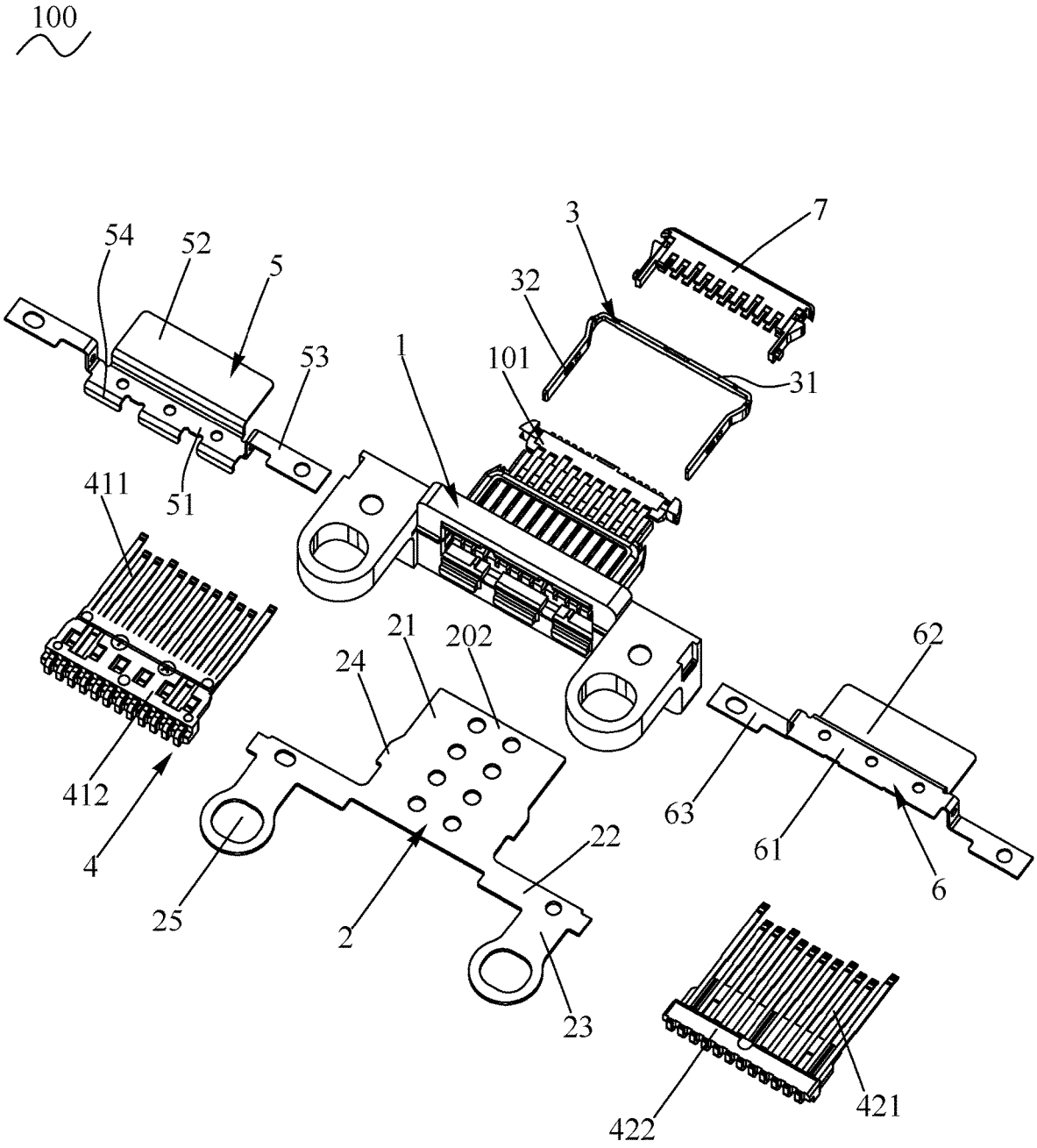
FIG. 4 is another exploded view of the electrical connector of FIG. 1.
Figure 5:
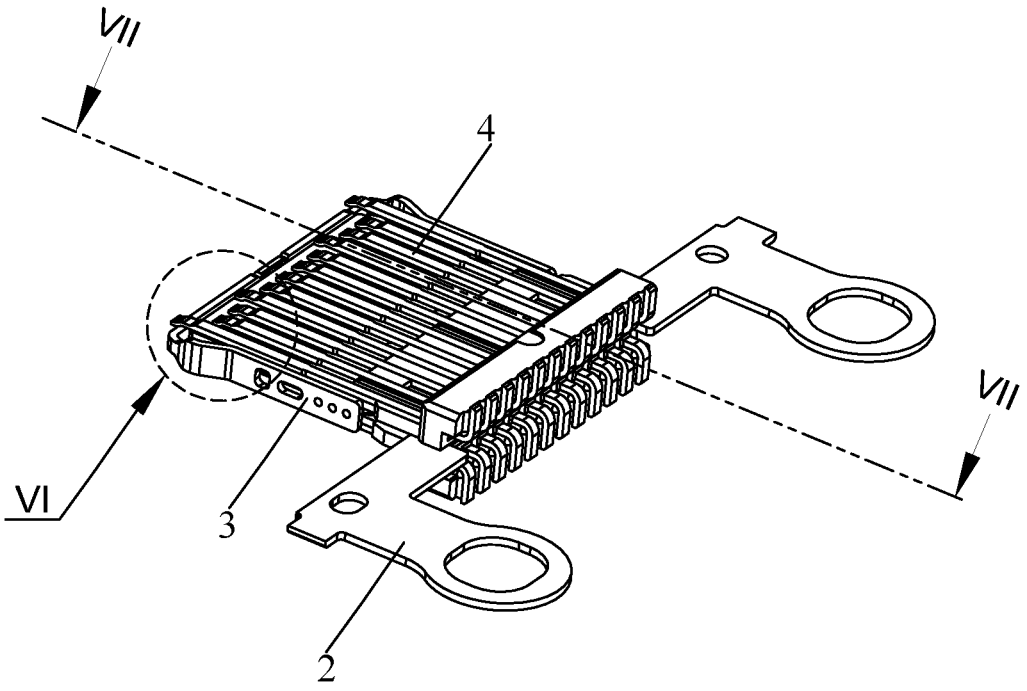
FIG. 5 is a partially perspective view of the electrical connector of FIG. 1.
Figure 6:
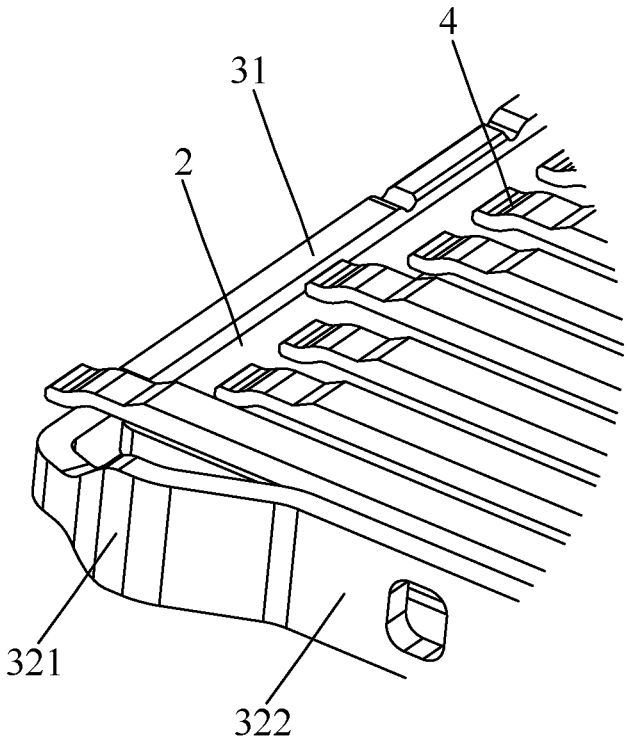
FIG. 6 is an enlarged view of an encircled portion VI of the electrical connector of FIG. 5.
Figure 7:
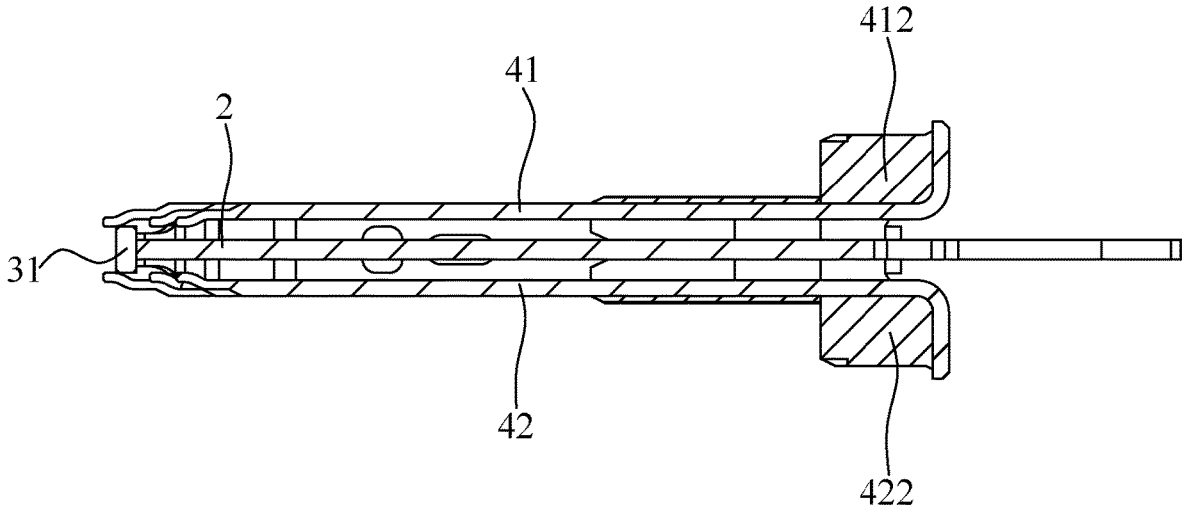
FIG. 7 is a sectional view of the electrical connector along a line VII-VII of FIG. 5.

Referring to FIG. 3 and FIG. 4, the center ground plate 2 has a main portion 21, two connecting portions 22, two extending portions 23, at least two abutting portions 24 and two location holes 25. The terminal assembly 4 is disposed to a top surface and a bottom surface of the main portion 21, respectively. Two opposite sides of a rear end of the main portion 21 oppositely extend outward to form the two connecting portions 22. Each connecting portion 22 is a long plane strip shape. The two connecting portions 22 are used for locating the upper ground plate 5 and the lower ground plate 6. Two opposite sides of rear surfaces of the two connecting portions 22 extend rearward to form the two extending portions 23. Each extending portion 23 is a long plane plate shape. Rear ends of the two extending portions 23 define the two circular location holes 25, respectively. At least two portions of two opposite sides of a middle of the main portion 21 oppositely protrude outward to form the at least two abutting portions 24. In the preferred embodiment, the at least two abutting portions 24 are used for being soldered to a corresponding mechanism of the strengthening ground strap 3 to realize reinforcing a structure strength of the electrical connector 100. Top surfaces of the two extending portions 23 are exposed out of the insulating housing 1 to be convenient for a glue sealing process and be beneficial for a production and a manufacture.

A rear end of main portion 21 and the two connecting portions 22 are disposed in the base body 10 of the insulating housing 1. A front end of main portion 21 is disposed in the tongue portion 11 and the two stepping portions 12. The main portion 21 is fastened in the tongue portion 12. The main portion 21 has two opposite attaching surfaces 202, two opposite side edges 203, and a front edge 204 connected with fronts of the two opposite side edges 203. The two opposite attaching surfaces 202 are connected with tops and bottoms of the two opposite side edges 203 and the front edge 204 of the main portion 21. The two opposite attaching surfaces 202 of the main portion 21 are surrounded by the two opposite side edges 203 and the front edge 204 of the main portion 21. The two opposite attaching surfaces 202 of the main portion 21 are corresponding to and located between the two opposite connecting surfaces 101 of the tongue portion 11, the two opposite side edges 203 of the main portion 21 are corresponding to the two opposite side surfaces 102 of the tongue portion 11, the front edge 204 of the main portion 21 is corresponding to the front surface 103 of the tongue portion 11. The two opposite attaching surfaces 202 of the main portion 21 are defined as the top surface and the bottom surface of the main portion 21. The two extending portions 23 of the center ground plate 2 are disposed in the two flanks 13 of the insulating housing 1. The location holes 25 of the two extending portions 23 are corresponding to the location perforations 14 of the two flanks 13 along an up-down direction.

Referring to FIG. 3 to FIG. 8, in the preferred embodiment, the strengthening ground strap 3 is a lying U shape structure. The mouth of the lying U-shaped strengthening ground strap 3 faces rearward. The strengthening ground strap 3 is used for being soldered to fasten the strengthening ground strap 3 to a front surface and two opposite sides of the main portion 21 of the center ground plate 2 to realize fixing and locating the strengthening ground strap 3 with the center ground plate 2.

The strengthening ground strap 3 is spot soldered to a front of an outer periphery of the main portion 21 of the center ground plate 2. The strengthening ground strap 3 has a front slice 31 and two lateral slices 32. The front slice 31 is fastened to and connected with a front surface of the center ground plate 2. The two lateral slices 32 are disposed to the two opposite sides of the center ground plate 2. The front slice 31 is fastened to and connected with the front edge of the main portion 21. A top edge of the front slice 31 is higher than a top surface of the center ground plate 2, so an altitude difference is formed between the top edge of the front slice 31 and the top surface of the center ground plate 2. A bottom edge of the front slice 31 projects beyond a bottom surface of the center ground plate 2, so an altitude difference is formed between the bottom edge of the front slice 31 and the bottom surface of the center ground plate 2. Because the strengthening ground strap 3 is clamped between an upper portion and a lower portion of the terminal assembly 4, an electromagnetic interference of a corresponding mechanism of the terminal assembly 4 is reduced to improve a stability of high speed transmission of the electrical connector 100.

Two opposite sides of the front slice 31 extend rearward and towards the center ground plate 2 to form the two lateral slices 32. The two lateral slices 32 are disposed to the two opposite sides of the main portion 21, and the two lateral slices 32 are perpendicular to the main portion 21. Each lateral slice 32 includes an extending arm 322, and a protruding portion 321 connected with the two opposite sides of the front slice 31. The two opposite sides of the front slice 31 are oppositely arched outward to form two protruding portions 321. The protruding portion 321 of each lateral slice 32 is used for providing a maintaining force of the electrical connector 100 at the time of the electrical connector 100 being inserted or withdrawn. A rear end of each protruding portion 321 extends rearward to form the extending arm 322. In the preferred embodiment, a rear end of each extending arm 322 is soldered to and fastened to one abutting portion 24 of the center ground plate 2 and is surrounded by the insulating housing 1, so that the structure strength of the electrical connector 100 is reinforced.

The strengthening ground strap 3 is fastened to the front surface 103 and the two opposite side surfaces 102 of the tongue portion 11 of the insulating housing 1. The front slice 31 is disposed to the front edge 204 of the main portion 21. The two lateral slices 32 are disposed outside the two opposite side edges 203 of the main portion 21. An inner surface of the front slice 31 is corresponding to the front edge 204 of the main portion 21, the top edge and the bottom edge of the front slice 31 are opposite to each other and exposed to fronts of the two opposite connecting surfaces 101 of the tongue portion 11, two inner surfaces of the two lateral slices 32 are corresponding to the two opposite side edges 203 of the main portion 21, middles of top surfaces and bottom surfaces of the two lateral slices 32 are exposed to two opposite sides of the tongue portion 11. The front slice 31 of the strengthening ground strap 3 is exposed to the front surface 103 of the tongue portion 11. The two protruding portions 321 are exposed to fronts of the two opposite side surfaces 102 of the tongue portion 11. Rear ends of the two extending arms 322 are disposed in the two stepping portions 12 of the insulating housing 1.

In the preferred embodiment, the main portion 21 is stamped by a metal plate. Two surfaces of the main portion 21 are disposed horizontally and are opposite to each other along an up-to-down direction. Four edges of the main portion 21 connected between the two surfaces of the main portion 21 are disposed towards a front direction, a rear direction and two side directions. The strengthening ground strap 3 is formed by a metal strip. Two opposite sides of the metal strip are bent towards the main portion 21 to form the strengthening ground strap 3.

Two surfaces of the front slice 31 are disposed vertically, and are opposite to each other along a front-to-rear direction. The top edge and the bottom edge of the front slice 31 connected between the two surfaces of the front slice 31 are oppositely disposed along the up-down direction. Two surfaces of each lateral slice 32 are disposed vertically and are opposite to each other along a transverse direction. A top edge and a bottom edge of each lateral slice 32 connected between the two surfaces of each lateral slice 32 are oppositely disposed along the up-down direction.

Thus, the strengthening ground strap 3 is disposed perpendicular to the center ground plate 2 and is vertically disposed, so that the structure strength of the electrical connector 100 is reinforced. Furthermore, comparing with electromagnetic interferences being blocked by edges of the current connector in prior art, electromagnetic interferences which are transmitted to or transmitted out of the electrical connector 100 along a longitudinal direction and the transverse direction are blocked by the surfaces of the strengthening ground strap 3, the electromagnetic interferences along the longitudinal direction and the transverse direction are capable of being effectively reduced.

Figure 8:
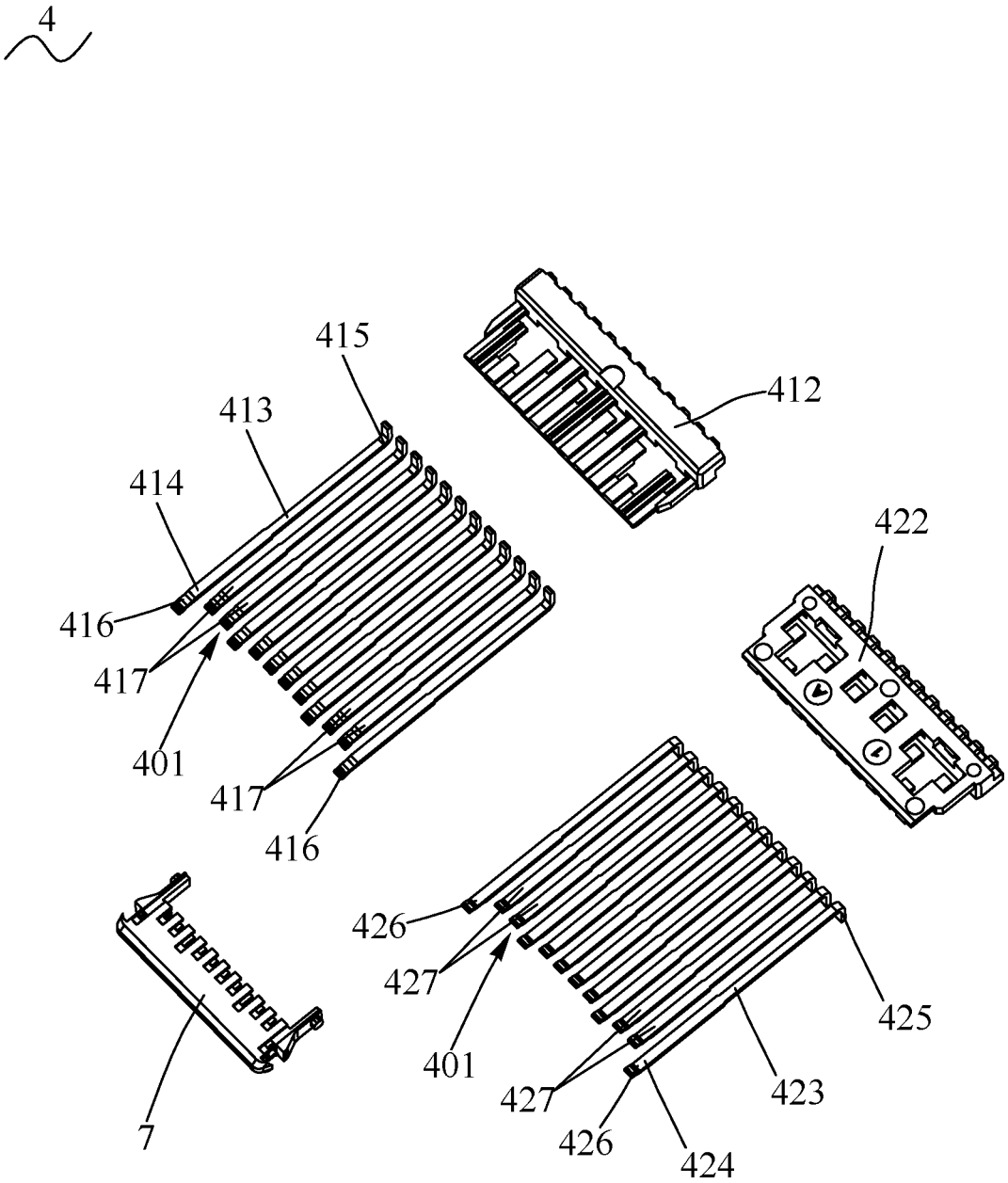
FIG. 8 is an exploded view of a terminal assembly of the electrical connector of FIG. 1.

Referring to FIG. 3, FIG. 4 and FIG. 8, the terminal assembly 4 is disposed in and fastened in the insulating housing 1. The terminal assembly 4 includes an upper terminal assembly 41 and a lower terminal assembly 42. The terminal assembly 4 includes a plurality of high speed terminals 401. The plurality of the high speed terminals 401 are disposed among the front slice 31 and the two lateral slices 32. The upper terminal assembly 41 is disposed on the top surface of the main portion 21, and the lower terminal assembly 42 is disposed under the bottom surface of the main portion 21. Preferably, the upper terminal assembly 41 is symmetrical to the lower terminal assembly 42 with respect to the center ground plate 2. The upper terminal assembly 41 includes a plurality of upper terminals 411 and an upper base portion 412. In the preferred embodiment, the plurality of the upper terminals 411 of the upper terminal assembly 41 include twelve upper terminals 411.

Each upper terminal 411 has an upper fastening portion 413, an upper contact portion 414 and an upper soldering portion 415. The plurality of the upper terminals 411 are fastened to the upper base portion 412. The upper fastening portions 413 of the plurality of the upper terminals 411 are fastened in and surrounded by the upper base portion 412. Front ends of the upper fastening portions 413 of the plurality of the upper terminals 411 extend frontward to form the upper contact portions 414 of the plurality of the upper terminals 411 projecting beyond a front surface of the upper base portion 412. Front ends of the upper contact portions 414 of the plurality of the upper terminals 411 are slightly arched upward and thinner than the upper fastening portions 413 of the plurality of the upper terminals 411. The front ends of the upper contact portions 414 of the plurality of the upper terminals 411 are surrounded by the docking portion 7. Rear ends of the upper fastening portions 413 of the plurality of the upper terminals 411 are bent upward to form the upper soldering portions 415 of the plurality of the upper terminals 411 projecting beyond a rear surface of the upper base portion 412. The plurality of the upper terminals 411 include a plurality of upper ground terminals 416 and a plurality of upper high speed terminals 417. In the preferred embodiment, lengths of the plurality of the upper ground terminals 416 are longer than lengths of the plurality of the upper high speed terminals 417. Front ends of the plurality of the upper ground terminals 416 project beyond a front surface of the front slice 31, and front ends of the plurality of the upper high speed terminals 417 are located on the main portion 21.

In the preferred embodiment, the lower terminal assembly 42 includes a plurality of lower terminals 421 and a lower base portion 422. The plurality of the lower terminals 421 of the lower terminal assembly 42 include twelve lower terminals 421. Each lower terminal 421 has a lower fastening portion 423, a lower contact portion 424 and a lower soldering portion 425. The plurality of the lower terminals 421 are fastened to the lower base portion 422. The lower fastening portions 423 of the plurality of the lower terminals 421 are fastened in and surrounded by the lower base portion 422. Front ends of the lower fastening portions 423 extend frontward to form the lower contact portions 424 of the plurality of the lower terminals 421 projecting beyond a front surface of the lower base portion 422. The front ends of the lower contact portions 424 are surrounded by the docking portion 7. Rear ends of the lower fastening portions 423 of the plurality of the lower terminals 421 are bent downward to form the lower soldering portions 425 of the plurality of the lower terminals 421 projecting beyond a rear surface of the lower base portion 422. The plurality of the lower terminals 421 include a plurality of lower ground terminals 426 and a plurality of lower high speed terminals 427. In the preferred embodiment, lengths of the plurality of the lower ground terminals 426 are longer than lengths of the plurality of the lower high speed terminals 427. Front ends of the plurality of the lower ground terminals 426 project beyond the front surface of the front slice 31, front ends of the plurality of the lower high speed terminals 427 are located under the main portion 21. Because the strengthening ground strap 3 is disposed to fronts of outsides of the upper terminal assembly 41 and the lower terminal assembly 42 of the terminal assembly 4, electromagnetic interferences of the plurality of the upper high speed terminals 417 and the plurality of the lower high speed terminals 427 of the terminal assembly 4 are reduced. The plurality of the high speed terminals 401 include the plurality of the upper high speed terminals 417 and the plurality of the lower high speed terminals 427.

A rear end of the upper base portion 412 and the rear ends of the upper fastening portions 413 of the plurality of the upper terminals 411 are disposed in the base body 10 of the insulating housing 1. A rear end of the lower base portion 422 and the rear ends of the lower fastening portions 423 of the plurality of the lower terminals 421 are disposed in the base body 10 of the insulating housing 1. A front end of the upper base portion 412 and the front ends of the upper fastening portions 413 of the plurality of the upper terminals 411 are disposed between the two stepping portions 12. A front end of the lower base portion 422 and the front ends of the lower fastening portions 423 of the plurality of the lower terminals 421 are disposed between the two stepping portions 12 of the insulating housing 1. The upper contact portions 414 of the plurality of the upper terminals 411 are exposed out of the top surface of the tongue portion 11. The lower contact portions 424 of the plurality of the lower terminals 421 are exposed out of the bottom surface of the tongue portion 11. The upper soldering portions 415 of the plurality of the upper terminals 411 are exposed out of the rear surface of the base body 10 of the insulating housing 1. The lower soldering portions 425 of the plurality of the lower terminals 421 are exposed out of the rear surface of the base body 10.

Referring to FIG. 1 to FIG. 8, the upper ground plate 5 is disposed above the upper fastening portions 413 of the plurality of the upper terminals 411, and the lower ground plate 6 is disposed under the lower fastening portions 423 of the plurality of the lower terminals 421. The upper ground plate 5 is disposed opposite to the lower ground plate 6. In the preferred embodiment, the upper ground plate 5 is soldered to the top surface of the center ground plate 2, and the lower ground plate 6 is soldered to the bottom surface of the center ground plate 2.

The upper ground plate 5 has an upper fastening plate 51, an upper connecting plate 52, two upper soldering pieces 53 and a plurality of upper extending feet 54. A front end of the upper fastening plate 51 is bent downward and then extends frontward to form the upper connecting plate 52. Two opposite sides of the upper fastening plate 51 are bent downward and then extend outward to form the two upper soldering pieces 53, respectively. The two upper soldering pieces 53 are soldered to top surfaces of the two connecting portions 22. Several portions of a rear end of the upper fastening plate 51 are bent upward and then extend upward to form the plurality of the upper extending feet 54. The plurality of the upper extending feet 54 are spaced from one another.

When the electrical connector 100 is connected with a docking connector, the upper connecting plate 52 is connected with a ground structure of the docking connector, the plurality of the upper extending feet 54 are used for increasing a soldering area of the electrical connector 100 to be soldered with the docking connector.

The lower ground plate 6 has a lower fastening plate 61, a lower connecting plate 62 and two lower soldering pieces 63. A front end of the lower fastening plate 61 is bent upward and then extends frontward to form the lower connecting plate 62. Two opposite sides of the lower fastening plate 61 are bent upward and then extend outward to form the two lower soldering pieces 63. The two lower soldering pieces 63 are soldered to bottom surfaces of the two connecting portions 22. When the electrical connector 100 is connected with the docking connector, the lower connecting plate 62 is connected with the ground structure of the docking connector.

The upper fastening plate 51 and the two upper soldering pieces 53 of the upper ground plate 5 are disposed in the base body 10 of the insulating housing 1. The upper connecting plate 52 of the upper ground plate 5 is exposed to a top surface of one stepping portion 12 of the insulating housing 1. The plurality of the upper extending feet 54 of the upper ground plate 5 are exposed to the rear surface of the base body 10. The lower fastening plate 61 and the two lower soldering pieces 63 of the lower ground plate 6 are disposed in the base body 10 of the insulating housing 1. The lower connecting plate 62 of the lower ground plate 6 is exposed to a bottom surface of the other stepping portion 12 of the insulating housing 1. A rear end of the lower fastening plate 61 of the lower ground plate 6 is exposed to the rear surface of the base body 10.

A front end of the tongue portion 11 of the insulating housing 1 is surrounded by the docking portion 7. The docking portion 7 is disposed to a front end of the terminal assembly 4. The front ends of the upper contact portions 414 of the plurality of the upper terminals 411 and the front ends of the lower contact portions 424 of the plurality of the lower terminals 421 are surrounded by the docking portion 7 to prevent the terminal assembly 4 from warping. In addition, the front slice 31 is surrounded by the docking portion 7.

When the electrical connector 100 is assembled, firstly, the plurality of the upper terminals 411 and the upper base portion 412 are integrally molded by virtue of an injection molding technology to form the upper terminal assembly 41, and the plurality of the lower terminals 421 and the lower base portion 422 are integrally molded by virtue of the injection molding technology to form the lower terminal assembly 42. And then, the center ground plate 2 is clamped between the upper terminal assembly 41 and the lower terminal assembly 42. The upper ground plate 5 is disposed above the upper terminal assembly 41. The lower ground plate 6 is disposed under the lower terminal assembly 42, the strengthening ground strap 3 is disposed to the front surface and the two opposite sides of the center ground plate 2. Later, the two upper soldering pieces 53 of the upper ground plate 5 are soldered to the two connecting portions 22 of the center ground plate 2, the two lower soldering pieces 63 of the lower ground plate 6 are soldered to the two connecting portions 22 of the center ground plate 2, and the rear ends of the two extending arms 322 of the strengthening ground strap 3 are soldered to the at least two abutting portions 24 of the center ground plate 2 and are surrounded by the insulating housing 1. The rear ends of the two extending arms 322 of the two protruding portions 321 are disposed between the two stepping portions 12 of the insulating housing 1. Last, the center ground plate 2, the strengthening ground strap 3, the terminal assembly 4, the upper ground plate 5 and the lower ground plate 6 are together molded by the injection molding technology to form the insulating housing 1 surrounding outsides of the center ground plate 2, the strengthening ground strap 3, the terminal assembly 4, the upper ground plate 5 and the lower ground plate 6. At last, the docking portion 7 is formed and molded at the front end of the insulating housing 1 by the injection molding technology.

When the electrical connector 100 is inserted into or withdrawn from the docking connector, the center ground plate 2 and the strengthening ground strap 3 form a stereo structure by virtue of the strengthening ground strap 3 being perpendicular to the main portion 21, so that the structure strength of the electrical connector 100 is reinforced, consequently, the docking portion 7 and the terminal assembly 4 are prevented from being broken or deformed in a process of the electrical connector 100 being inserted or withdrawn, and the electrical connector 100 is prevented from being caused to be damaged.

As described above, the strengthening ground strap 3 of the electrical connector 100 is spot soldered to the front of the outer periphery of the main portion 21 of the center ground plate 2, the front slice 31 is fastened to and connected with the front edge of the main portion 21, the top edge of the front slice 31 is higher than the top surface of the center ground plate 2, so the altitude difference is formed between the top edge of the front slice 31 and the top surface of the center ground plate 2, the bottom edge of the front slice 31 projects beyond the bottom surface of the center ground plate 2, so the altitude difference is formed between the bottom edge of the front slice 31 and the bottom surface of the center ground plate 2, because the strengthening ground strap 3 is disposed to the fronts of the outsides of the upper terminal assembly 41 and the lower terminal assembly 42 of the terminal assembly 4, the electromagnetic interferences of the plurality of the upper high speed terminals 417 and the plurality of the lower high speed terminals 427 of the terminal assembly 4 are reduced to improve the stability of high speed transmission of the electrical connector 100. As a result, the electrical connector 100 has the better anti-electromagnetic interference capability and a better speed transmission stability.

What is claimed is:

1. An electrical connector, comprising:

an insulating housing, having a base body, a tongue portion, two stepping portions, two flanks and two location perforations, the tongue portion being extended frontward from a middle of a front surface of the base body, rears of a top surface and a bottom surface of the tongue portion being connected with the front surface of the base body, the rears of the top surface and the bottom surface of the tongue portion having the two stepping portions connected with the front surface of the base body, lower portions of two opposite sides of a rear surface of the base body extend rearward to form the two flanks, rear ends of the two flanks having the two location perforations penetrating through a top surface and a bottom surface of the two flanks, the front slice of the strengthening ground strap being exposed to a front surface of the tongue portion;

a center ground plate fastened in the insulating housing;

a strengthening ground strap fastened to a front surface and fronts of two opposite sides of the insulating housing, the strengthening ground strap having a front slice and two lateral slices, the front slice being fastened to and connected with a front surface of the center ground plate, a top edge of the front slice being higher than a top surface of the center ground plate, so an altitude difference being formed between the top edge of the front slice and the top surface of the center ground plate, a bottom edge of the front slice projecting beyond a bottom surface of the center ground plate, so an altitude difference being formed between the bottom edge of the front slice and the bottom surface of the center ground plate, two opposite sides of the front slice extending rearward and towards the center ground plate to form the two lateral slices, the two lateral slices being disposed to two opposite sides of the center ground plate; and a terminal assembly fastened in the insulating housing, the terminal assembly including a plurality of high speed terminals and at least two ground terminals, the plurality of the high speed terminals being disposed among the front slice and the two lateral slices, lengths of the ground terminals being longer than lengths of the plurality of the high speed terminals, front ends of the ground terminals projected beyond a front surface of the front slice.

2. The electrical connector as claimed in claim 1, further comprising a docking portion, the docking portion being disposed to a front end of the terminal assembly, a front end of the insulating housing being surrounded by a docking portion, the front slice being surrounded by the docking portion.

3. The electrical connector as claimed in claim 1, wherein each lateral slice includes an extending arm, and a protruding portion connected with the two opposite sides of the front slice, the two opposite sides of the front slice are oppositely arched outward to form two protruding portions, the two protruding portions are exposed to fronts of the two opposite side surfaces of the tongue portion, a rear end of each protruding portion extends rearward to form the extending arm, rear ends of the two extending arms are disposed between the two stepping portions of the insulating housing.

4. The electrical connector as claimed in claim 3, wherein the center ground plate has a main portion, a front end of main portion is disposed in the tongue portion and the two stepping portions, at least two portions of two opposite sides of a middle of the main portion oppositely protrude outward to form at least two abutting portions, the rear ends of the two extending arms of the two protruding portions are soldered to the at least two abutting portions, the rear end of each extending arm is soldered to and fastened to one abutting portion of the center ground plate and is surrounded by the insulating housing.

5. The electrical connector as claimed in claim 4, wherein two opposite sides of a rear end of the main portion oppositely extend outward to form two connecting portions, each connecting portion is a long plane strip shape, two opposite sides of rear surfaces of the two connecting portions extend rearward to form two extending portions, each extending portion is a long plane plate shape, rear ends of the two extending portions define two circular location holes, the rear end of main portion and the two connecting portions are disposed in the base body, the two extending portions of the center ground plate are disposed in the two flanks of the insulating housing, the location holes of the two extending portions are corresponding to the location perforations of the two flanks along an up-down direction.

6. The electrical connector as claimed in claim 5, wherein the terminal assembly includes an upper terminal assembly disposed on a top surface of the main portion, the upper terminal assembly includes a plurality of upper terminals and an upper base portion, each upper terminal has an upper fastening portion, an upper contact portion and an upper soldering portion, the plurality of the upper terminals are fastened to the upper base portion, the upper fastening portions of the plurality of the upper terminals are fastened in and surrounded by the upper base portion, front ends of the upper fastening portions of the plurality of the upper terminals extend frontward to form the upper contact portions of the plurality of the upper terminals projecting beyond a front surface of the upper base portion, front ends of the upper contact portions of the plurality of the upper terminals are slightly arched upward and thinner than the upper fastening portions of the plurality of the upper terminals, rear ends of the upper fastening portions of the plurality of the upper terminals are bent upward to form the upper soldering portions of the plurality of the upper terminals projecting beyond a rear surface of the upper base portion.

7. The electrical connector as claimed in claim 6, wherein a rear end of the upper base portion and the rear ends of the upper fastening portions of the plurality of the upper terminals are disposed in the base body, a front end of the upper base portion and the front ends of the upper fastening portions of the plurality of the upper terminals are disposed between the two stepping portions, the upper contact portions of the plurality of the upper terminals are exposed out of the top surface of the tongue portion, the upper soldering portions of the plurality of the upper terminals are exposed out of the rear surface of the base body.

8. The electrical connector as claimed in claim 6, wherein the terminal assembly includes a lower terminal assembly disposed under a bottom surface of the main portion, the lower terminal assembly is symmetrical to the upper terminal assembly with respect to the center ground plate, the lower terminal assembly includes a plurality of lower terminals and a lower base portion, each lower terminal has a lower fastening portion, a lower contact portion and a lower soldering portion, the plurality of the lower terminals are fastened to the lower base portion, the lower fastening portions of the plurality of the lower terminals are fastened in and surrounded by the lower base portion, front ends of the lower fastening portions of the plurality of the lower terminals extend frontward to form the lower contact portions of the plurality of the lower terminals projecting beyond a front surface of the lower base portion, rear ends of the lower fastening portions of the plurality of the lower terminals are bent downward to form the lower soldering portions of the plurality of the lower terminals projecting beyond a rear surface of the lower base portion.

9. The electrical connector as claimed in claim 8, wherein a rear end of the lower base portion and the rear ends of the lower fastening portions of the plurality of the lower terminals are disposed in the base body, a front end of the lower base portion and the front ends of the lower fastening portions of the plurality of the lower terminals are disposed between the two stepping portions, the lower contact portions of the plurality of the lower terminals are exposed out of the bottom surface of the tongue portion, the lower soldering portions of the plurality of the lower terminals are exposed out of the rear surface of the base body.

10. The electrical connector as claimed in claim 8, wherein the plurality of the lower terminals include a plurality of lower ground terminals and a plurality of lower high speed terminals, lengths of the plurality of the lower ground terminals are longer than lengths of the plurality of the lower high speed terminals, front ends of the plurality of the lower ground terminals project beyond a front surface of the front slice, front ends of the plurality of the lower high speed terminals are located under the main portion.

11. The electrical connector as claimed in claim 5, further comprising an upper ground plate and a lower ground plate, the upper ground plate being soldered to the top surface of the center ground plate, the lower ground plate being soldered to the bottom surface of the center ground plate, the upper ground plate being disposed opposite to the lower ground plate, the upper ground plate being symmetrical to the lower ground plate with respect to the center ground plate.

12. The electrical connector as claimed in claim 11, wherein the upper ground plate has an upper fastening plate, an upper connecting plate, two upper soldering pieces and a plurality of upper extending feet, a front end of the upper fastening plate is bent downward and then extends frontward to form the upper connecting plate, two opposite sides of the upper fastening plate are bent downward and then extend outward to form the two upper soldering pieces, respectively, the two upper soldering pieces are soldered to top surfaces of the two connecting portions, several portions of a rear end of the upper fastening plate are bent upward and then extend upward to form the plurality of the upper extending feet, the plurality of the upper extending feet are spaced from one another.

13. The electrical connector as claimed in claim 12, wherein the upper fastening plate and the two upper soldering pieces of the upper ground plate are disposed in the base body of the insulating housing, the upper connecting plate of the upper ground plate is exposed to a top surface of one stepping portion of the insulating housing, the plurality of the upper extending feet of the upper ground plate are exposed to the rear surface of the base body of the insulating housing.

14. The electrical connector as claimed in claim 13, wherein the lower ground plate has a lower fastening plate, a lower connecting plate and two lower soldering pieces, a front end of the lower fastening plate is bent upward and then extends frontward to form the lower connecting plate, two opposite sides of the lower fastening plate are bent upward and then extend outward to form the two lower soldering pieces, the two lower soldering pieces are soldered to bottom surfaces of the two connecting portions.

15. The electrical connector as claimed in claim 14, wherein the lower fastening plate and the two lower soldering pieces of the lower ground plate are disposed in the base body of the insulating hosing, the lower connecting plate of the lower ground plate is exposed to a bottom surface of the other stepping portion of the insulating housing, a rear end of the lower fastening plate of the lower ground plate is exposed to the rear surface of the base body of the insulating hosing.

16. An electrical connector, comprising:

an insulating housing having a base body, and a tongue portion extended frontward from a middle of a front surface of the base body, the tongue portion having two opposite connecting surfaces, two opposite side surfaces, and a front surface connected with fronts of the two opposite side surfaces, the two opposite side surfaces and the front surface of the tongue portion surrounding the two opposite connecting surfaces of the tongue portion;

a center ground plate fastened in the insulating housing, the center ground plate having a main portion fastened in the tongue portion, the main portion having two opposite attaching surfaces, two opposite side edges and a front edge, the two opposite attaching surfaces of the main portion being surrounded by the two opposite side edges and the front edge of the main portion, the two opposite attaching surfaces of the main portion being corresponding to and located between the two opposite connecting surfaces of the tongue portion, the two opposite side edges of the main portion being corresponding to the two opposite side surfaces of the tongue portion, the front edge of the main portion being corresponding to the front surface of the tongue portion;

a strengthening ground strap fastened to the front surface and the two opposite side surfaces of the tongue portion of the insulating housing, the strengthening ground strap having a front slice and two lateral slices, two opposite sides of the front slice extending rearward and towards the center ground plate to form the two lateral slices, the front slice being disposed to the front edge of the main portion, the two lateral slices being disposed outside the two opposite side edges of the main portion, an inner surface of the front slice being corresponding to the front edge of the main portion, a top edge and a bottom edge of the front slice being opposite to each other and exposed to fronts of the two opposite connecting surfaces of the tongue portion, two inner surfaces of the two lateral slices being corresponding to the two opposite side edges of the main portion, middles of top surfaces and bottom surfaces of the two lateral slices being exposed to two opposite sides of the tongue portion;

a terminal assembly fastened in the insulating housing, the terminal assembly including a plurality of high speed terminals, the plurality of the high speed terminals being disposed among the front slice and the two lateral slices; and a docking portion, the docking portion disposed to a front end of the terminal assembly, a front end of the insulating housing being surrounded by the docking portion, the front slice being surrounded by the docking portion.

17. The electrical connector as claimed in claim 16, wherein the insulating housing has two stepping portions, two flanks and two location perforations, the two opposite connecting surfaces of the tongue portion are defined as a top surface and a bottom surface of the tongue portion, the tongue portion is extended frontward from a middle of the front surface of the base body, rears of the top surface and the bottom surface of the tongue portion are connected with the front surface of the base body, the rears of the top surface and the bottom surface of the tongue portion have the two stepping portions connected with the front surface of the base body, lower portions of two opposite sides of a rear surface of the base body extend rearward to form the two flanks, rear ends of the two flanks have the two location perforations penetrating through a top surface and a bottom surface of the two flanks, the front slice of the strengthening ground strap is exposed to the front surface of the tongue portion.

18. An electrical connector, comprising:

an insulating housing having a base body, a tongue portion, two stepping portions, two flanks and two location perforations, the tongue portion extended frontward from a middle of a front surface of the base body, rears of a top surface and a bottom surface of the tongue portion being connected with a front surface of the base body, the rears of the top surface and the bottom surface of the tongue portion having the two stepping portions connected with the front surface of the base body, lower portions of two opposite sides of a rear surface of the base body extending rearward to form the two flanks, rear ends of the two flanks having the two location perforations penetrating through a top surface and a bottom surface of the two flanks, the tongue portion having two opposite connecting surfaces, two opposite side surfaces, and a front surface connected with the two opposite side surfaces, the two opposite connecting surfaces of the tongue portion being connected with tops and bottoms of the two opposite side surfaces and the front surface of the tongue portion;

a center ground plate fastened in the insulating housing, the center ground plate having a main portion fastened in the tongue portion, the main portion having two opposite attaching surfaces, two opposite side edges, and a front edge connected with fronts of the two opposite side edges, the two opposite attaching surfaces being connected with tops and bottoms of the two opposite side edges and the front edge of the main portion, the two opposite attaching surfaces of the main portion being corresponding to and located between the two opposite connecting surfaces of the tongue portion, the two opposite side edges of the main portion being corresponding to the two opposite side surfaces of the tongue portion, the front edge of the main portion being corresponding to the front surface of the tongue portion;

a strengthening ground strap fastened to a front surface and fronts of two opposite sides of the insulating housing, the strengthening ground strap having a front slice and two opposite lateral slices, two opposite sides of the front slice extending rearward and towards the center ground plate to form the two lateral slices, the front slice being disposed to the front edge of the main portion, the two lateral slices being disposed outside the two opposite side edges of the main portion, an inner surface of the front slice being corresponding to the front edge of the main portion, a top edge and a bottom edge of the front slice being opposite to each other and exposed to fronts of the two opposite connecting surfaces of the tongue portion, two inner surfaces of the two lateral slices being corresponding to the two opposite side edges of the main portion, middles of top surfaces and bottom surfaces of the two lateral slices being exposed to two opposite sides of the tongue portion;

a terminal assembly fastened in the insulating housing, the terminal assembly including a plurality of high speed terminals, the plurality of the high speed terminals being disposed among the front slice and the two lateral slices;

an upper ground plate disposed to a top surface of the insulating housing; and a lower ground plate disposed to a bottom surface of the insulating housing, the upper ground plate being symmetrical to the lower ground plate with respect to the center ground plate.

* * * * *